US007446664B2

(12) United States Patent
White

(10) Patent No.: US 7,446,664 B2
(45) Date of Patent: Nov. 4, 2008

(54) REMOTE CHILD LOCATOR

(76) Inventor: Robert McCall White, 268 Stetson Dr., Danville, CA (US) 94506

( * ) Notice: Subject to any disclaimer, the term of this patent is extended or adjusted under 35 U.S.C. 154(b) by 0 days.

(21) Appl. No.: 11/123,908

(22) Filed: May 6, 2005

(65) Prior Publication Data

US 2006/0028346 A1 Feb. 9, 2006

Related U.S. Application Data

(60) Provisional application No. 60/569,520, filed on May 6, 2004.

(51) Int. Cl.
*G08B 23/00* (2006.01)

(52) U.S. Cl. ..... 340/573.1; 340/573.4; 340/539.12; 340/539.21; 340/539.23; 340/539.32; 340/825.36; 340/825.49

(58) Field of Classification Search ..... 340/573.4, 340/573.1, 539.12, 539.21, 539.23, 539.32, 340/825.36, 825.49
See application file for complete search history.

(56) References Cited

U.S. PATENT DOCUMENTS 4,598,272 A 7/1986 Cox
5,337,041 A 8/1994 Friedman
5,652,569 A * 7/1997 Gerstenberger et al. .. 340/573.4
5,689,240 A * 11/1997 Traxler ..... 340/573.4
5,995,007 A * 11/1999 Borja et al. ..... 340/573.4
6,078,260 A 6/2000 Desch
6,091,329 A 7/2000 Newman
6,127,931 A * 10/2000 Mohr ..... 340/573.4
6,243,039 B1 6/2001 Elliot
6,265,974 B1 * 7/2001 D'Angelo et al. ..... 340/568.1
6,278,370 B1 8/2001 Underwood
6,313,733 B1 11/2001 Kyte
6,326,891 B1 12/2001 Lin
6,486,777 B2 11/2002 Clark
6,593,851 B1 7/2003 Bornstein
7,042,361 B2 * 5/2006 Kazdin et al. ..... 340/573.4

* cited by examiner

*Primary Examiner*—Tai T Nguyen
(74) *Attorney, Agent, or Firm*—Knoble Yoshida & Dunleavy, LLC

(57) ABSTRACT

A system for tracking as lost child a receiver attached to the coupled to a small child. The system comprises a transmitter carried by the parent. A small receiver and activator is attached to the child. When the parent activates the transmitter, the receiver is activated and buzzer or beeper is set off.

16 Claims, 5 Drawing Sheets

REMOTE CHILD LOCATOR

CLAIM OF PRIORITY

This application claims priority to provisional application No. 60/569,520, filed on May 6, 2004, entitled "Remote Child Locator", which is incorporated by reference herein in its entirety.

FIELD OF THE INVENTION

The present invention is directed to the field of child protection. In particular, the present invention is directed to field of electronic child protection.

BACKGROUND OF THE INVENTION

In the United States each year, thousands of children are abducted or lost at public venues. The safety and welfare of children takes the utmost priority in the lives of most people. The public have been turning to technology more and more to protect children and to prevent their abduction, injury and harm. Such technological means have included both audio and video monitors, alarm systems and the like.

The risk of abduction is one of the greatest risks to parents and/or child care providers. While technology exists for protection of automobiles against similar threats such as car jacking and theft, this technology has not been used to protect children against similar threats. Many children become lost and/or abducted while returning from school, playing at a friend's house, while engaged in extended outdoor activities such as hiking or camping or while at malls and the like.

The prior art includes security devices in which a lost or abducted child can be located by using a radio receiver that monitors the signal transmitted by a matching transmitter in possession of the lost or abducted child. U.S. Pat. No. 6,593,851 discloses a two-way, parent-child communication system includes a parent unit and at least one child unit. The parent and child units are capable of both sending and receiving signals to and from the corresponding unit to cause any number of alerts or messages to be communicated to the parent, child and/or guardian. Each unit may include a number of different alert mechanisms, including an audible alert, a visual alert, a vibratory alert or voice messages.

U.S. Pat. No. 6,243,039 discloses a system that tracks the current and historical locations of a GPS locator device carried by a person provides widely available access to data referencing these locations, so that a parent can easily and frequently monitor the location of a child. Monitoring of a child's location may be conducted via a Web site, which provides graphical maps of location data, or via calling into a call center. The present invention also provides a means for a parent to trigger the automatic transmission of the device's location, via a Web site or call placed to a call center agent or a VRU. The present invention also provides a process of auto-notification of a device's movement that exceeds a prespecified threshold. The present invention also includes a capability to function as a proximity alert device.

U.S. Pat. No. 6,127,931 discloses a device for monitoring the movement of a person including a homing unit and a base unit. The homing unit includes a device for generating a homing signal and a transmitter for transmitting the homing signal at predetermined intervals. The base unit includes a receiver for receiving the homing signal, a processor for processing the homing signal to determine whether the homing unit is within a predetermined distance from the base unit and generating an alarm signal upon determining the homing unit is at a distance from the base unit greater than the predetermined distance. An alarm is provided on the base unit for alerting a user that the homing unit has moved a distance greater than the predetermined distance from the base unit upon receipt of the alarm signal from the processor. The alarm is at least one of an audible alarm, a visible alarm and a vibratory alarm. At least one of the base unit and homing unit includes a device for adjusting the predetermined distance. The processor determines a time between receipt of sequentially transmitted homing signals to determine the distance between the base unit and homing unit. The base unit further includes a display for displaying the distance between the base unit and homing unit and a direction to the homing unit from the base unit.

U.S. Pat. No. 6,278,370 discloses a child locating and tracking apparatus which provides for the location of a child that is lost, abducted or in general danger to be quickly located is disclosed. The apparatus uses a small transmitter that is always carried by the child and as such, is always present when danger arises. The transmitter is easily disguised and hidden in the child's clothing or personal adornments such as shoes, coats, watches, earrings, bracelets, rings and the like. The apparatus uses a system of world wide receivers such as those provided by local cellular telephone towers or by low earth orbiting satellites used for low power communication. When a child is lost or in danger, the child simply activates the transmitter which sends a signal to a central reporting station or stations where trained personnel will contact the respective parents and/or care givers to determine if the child could possibly be in danger. If an affirmative decision is reached, the monitoring station personnel will then assist the local law enforcement officials in the respective area anywhere in the world where the alarm was received in locating the child and removing the child from harm's path.

U.S. Pat. No. 5,689,240 shows a system that transmits and receives signals comprising a master unit and a remote unit, wherein a separation distance between the master unit and remote unit is continuously monitored and an alarm is activated on the master unit when no signal is received from the remote unit for at least a time longer than a preset interval. If the separation distance between the master and remote unit is exceeded for a time longer than a preset time interval, the remote unit activates an alarm attached to the remote unit. The master unit may also be used to activate manually the remote unit's alarm. A pin or key arrangement is provided that ensures that the remote unit is not deactivated without interfacing with the master unit.

U.S. Pat. No. 6,486,777 to Clark has an issue date of Nov. 26, 2002. This invention is directed to an apparatus and method for an operator to monitor the whereabouts of a subject, the apparatus comprising a portable remote unit connected to the subject, the remote unit including a remote unit power supply, a radio transmitter for sending a substantially constant remote unit radio signal, a radio receiver for receiving a base unit radio signal, a remote unit alarm, and a dye pack for releasing dye substantially responsive to submersion of the remote unit in water. The apparatus also includes a base unit in radio communication with the remote unit for enabling the operator to monitor the whereabouts of the remote unit, the base unit including a base unit power supply, a radio transmitter for sending the base unit radio signal, a radio receiver for receiving the substantially continuous remote unit radio signal, a distance estimator for substantially estimating the distance between the base unit and the remote unit, a base unit alarm responsive to the remote unit radio signal so that the base unit alarm is activated when the remote unit radio signal is altered, and a direction finding function for generally finding the direction from which the remote unit signal originates, relative to remote unit radio signal strength.

U.S. Pat. No. 6,078,260 discloses a system for monitoring the proximity and location of a child by a parent includes two transceiver units which communicate wirelessly. The child unit will transmit a signal to the parent unit so that the parent unit can determined the proximity of the child unit and its direction. A safe zone may be set by controls on the parent unit. When the child unit moves beyond the safe zone, the parent unit will generate an alert.

U.S. Pat. No. 6,326,891 shows compact warning device for preventing child from being lost comprises a high frequency distance-adjustable host transceiver and a plurality of slave transceivers wherein the high frequency host transceiver is carried by the parents and a high frequency slave transceiver is secured on a child, and the host and the slave transceivers can proceed bidirectional page or response with its counterpart. When one of the slave transceivers departs from the host transceiver beyond a preset security range, both the host and the slave transceiver will alarm to warn the child and the parents in order to prevent the child from being lost. Moreover, as this invention is capable of adjusting security range in multiple stages, it can fit various circumstantial conditions.

While the prior art discloses a number of systems directed to monitoring small children and the like, it is an object of the present invention to provide a system whereby a lost child or pet can be rapidly located by means of an electronic transmitter and receiver.

It is a further object of the present invention to provide a system whereby a transmitter can create an audible sound for the location of a lost child.

It is a further object of the present invention to provide a signal which can be heard by individuals proximate to the child.

It is a factor object of the invention to provide a device having a proximity sansor.

These and other objects of the present invention will become apparent from the detailed description and claims which follow.

SUMMARY OF THE INVENTION

In accordance with the invention, a child locator apparatus comprising: a receiver inserted with in an object held proximate to child and having a sound activator; a transmitter held by a parent and having an activating button to trigger an alert on the receiver which activates the sound activator.

In a further embodiment, the invention is a child locator apparatus comprising: a reciever inserted with in a child's toy affixed to the child's person; a transmitter held by a parent and having an activating button to trigger an alert on the receiver; and a proximity sensor which automatically activates the alert when the receiver is a predetermined distance from the transmitter.

In yet a further embodiment, the invention is a child locator apparatus comprising: a reciever inserted with in a child's toy affixed to the child's person; a transmitter held by a parent and having an activating button to trigger an alert on the receiver; and a proximity sensor with a distance setting ability which automatically activates the alert when the receiver is a predetermined distance from the transmitter.

In still a further embodiment, the invention is a child locator apparatus comprising: a reciever inserted with in a child's toy affixed to the child's person; a battery powered transmitter held by a parent and having an activating button to trigger an alert on the receiver; and a proximity sensor which automatically activates the alert when the receiver is a predetermined distance from the transmitter.

DETAILED DESCRIPTION OF THE INVENTION

The present invention is a remote child locator device which may be a sound audible device for locating lost or wandering children for distances up to two hundred feed and may further be adapted to include pets. A critical feature of the present invention is that the receiver can take the form of a baby toy, ball doll, or tiny car. As such, the receiver is inconspicuous and does not attract attention. In one embodiment of the invention, the receiver may be may be worn by a child. For example, the receiver may be a pair of sunglasses in which the receiver/transmitter is being used in the head support or ear piece. While the invention is being described in the context of a system in which the receiver is attached to the child and the transmitter to the parent, it will be readily apparent that this can be reversed.

The invention 10 comprises two basic components; a receiving/sound emitting device or module 12 and a transmitter module 14. The receiver/noise emitting device 12 will be contained within or on one of various common child associated items such as a small soccer ball, doll or toy. The device will be an effective, non-intrusive and low cost solution for helping parents find that wandering child that decides to play hide and seek amongst clothing displays and helps to reduce a potential kidnapper preying on a lost child.

Figure 1:
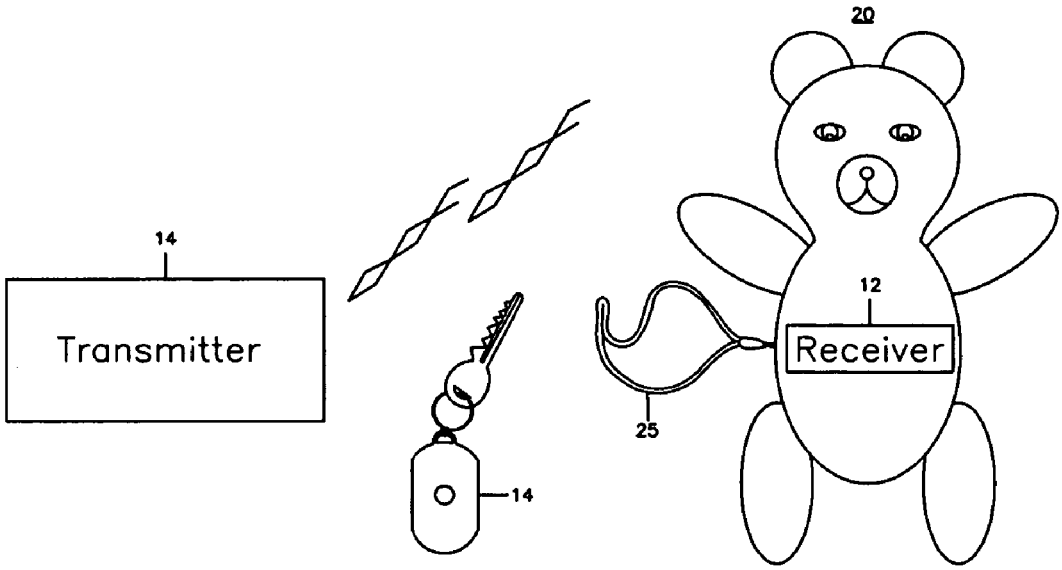
FIG. 1 is a perspective view of the child alert system of the present invention.

The invention is now more specifically described as follows. Referring now to FIG. 1, a perspective view of a child locating apparatus 10 is disclosed. As noted, the receiving/sound module 12 is shown within a child's adornment such as a toy, doll or trinket 20. The adornment 20 may be attached to the child by means of a retaining means 25, such as a chain or, alternatively, a zipper, fabric, buttons, snaps, clasps, lace or the like. It is important that the retaining means 25 holds the adornment 20 with the associated receiver module 12 in close contact with the child's body to prevent loss or removal. As noted, the adornment can be disguised as a pair of sunglasses.

The adult or parent typically holds the transmitter device 14 which may be associated with a small hand held device of the size and shape typically associated with automatic car door openers as shown in FIG. 1. The overall size of the transmitting module 14 is preferably two to three inches in length by approximately one inch in width. The transmitting module 14 has an activating button 18 and an on/off switch 22. The shape of the receiver by contrast is primarily dictated by the physical shape of the ornament 20 (as shown in FIG. 1).

The module further includes a power supply 23 and voltage regulator 25. The overall enclosure of the transmitting module 14 may, in one embodiment, comprise injection molded plastic with appropriate seals to allow its use under wet or submerged conditions. As noted, the transmitting module may be part of a key chain. The system further includes a time delay module 32.

The transmitting module 14 further includes a battery level indication light 30. The battery level indication light 30 will illuminate when less than a day's usable energy remains in the internal battery. The battery level indication light 30 should be observed daily by examining the transmitting module 14.

Figure 2:
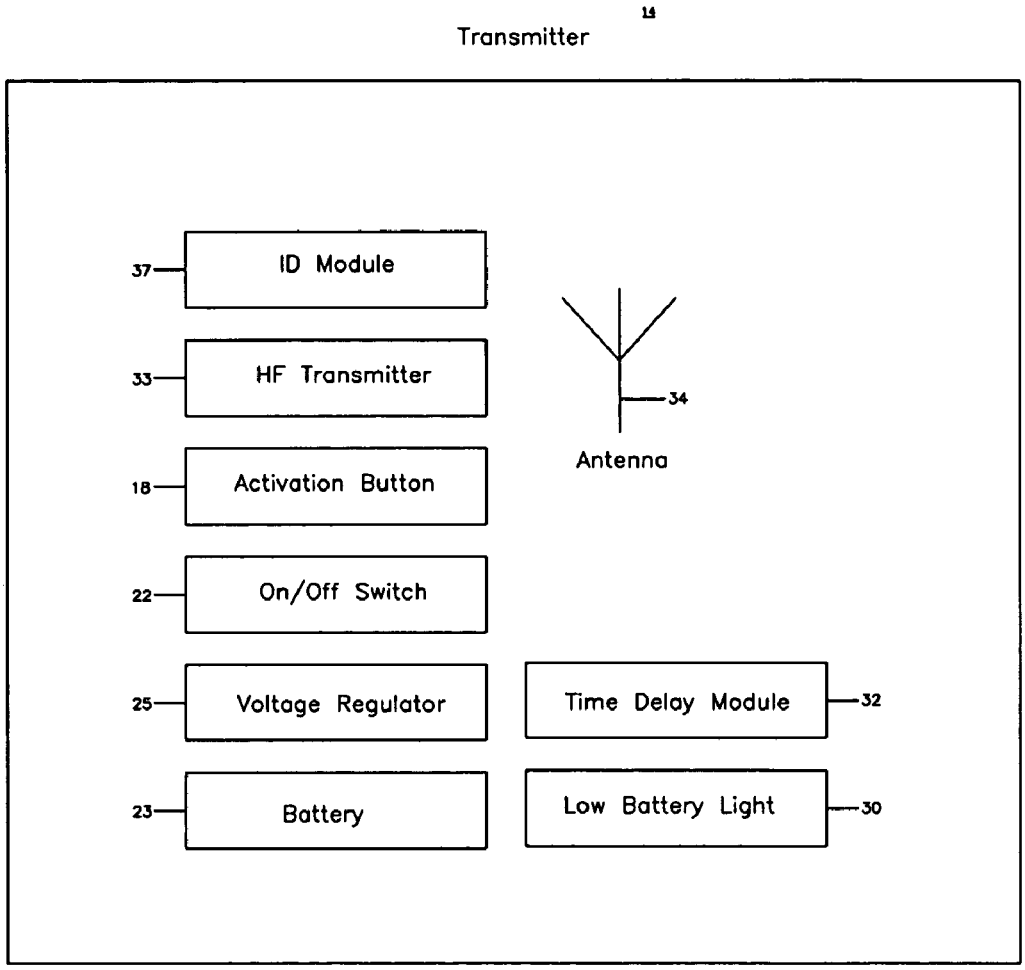
FIG. 2 discloses the transmitter module of the present invention.
Figure 3:
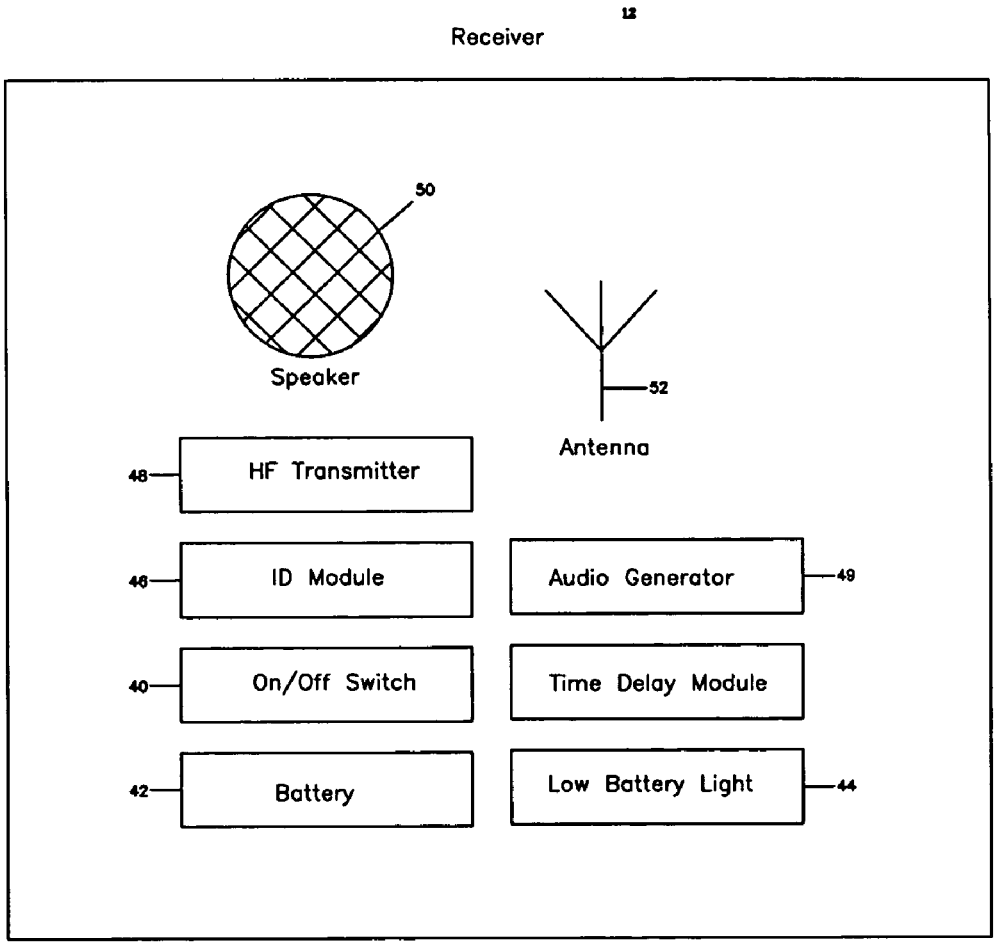
FIG. 3 is a block diagram of the receiver module of the present invention.

In operation, the parent or adult holds and mantains the transmitter. By depressing the activation button for a length of time greater than the pre-set time delay, an HF signal is transmitted via HF transmitter 33 which provides an output signal via antenna 34. The antenna 34 is envisioned to be of a loop type that may be embedded in the perimeter of the transmitting module 14 (as shown in FIG. 2), though it may be seen by those familiar in the art that other types such as microwave, dipole, multiple array and other type antennas will work equally as well and is not intended to be a limiting factor.

The activating button 18 provides an input to the radio frequency transmitter 33 through the form of a normally open activation switch. As noted, a time delay activation button 18 provides an input to a time delay module 32 through the form of a normally closed push-button switch. The time delay is intended to prevent inadvertent activation. The time delay module 32 is a simple, commonly known time delay circuit that accepts an input signal, and after a predetermined time delay, passes the input signal onto the HF transmitter. The time delay interval is envisioned to be on the order of five seconds.

The battery provides input power to a voltage regulator 25 as shown. In the event of low power output from the battery, an electrical signal is applied to the battery level indication light 30. The internal parameters of the voltage regulator module 25 are such that there is at least 24 hours of advance warning that the battery 23 is depleted of power before the battery ceases to function. Output power from the voltage regulator module is applied to the radio frequency transmitter 33 and to an identification module 37. The critical identification module 37 is set uniquely for every child locating and tracking apparatus 10 manufactured and posses a unique digital binary signature. This signature is applied to the radio frequency transmitter 33 through a digital signal path. All components envisioned to be of the microminiature nature and perhaps combined by use of Very Large Scale Integration or future electrical assembly method still under development.

The receiver module 12 includes an on/off switch 40, battery 42, and low battery light 44. The system also includes an HF receiver 46 and corresponding ID module 48 which matches the ID module 37 of the transmitter. An antenna is included as well. The receiver antenna 52 is similarly envisioned to be of a loop type that may also be embedded in the perimeter of the receiving module 12. Other types such as microwave, dipole, multiple array and other type antennas will work equally as well and is not intended to be a limiting factor.

In operation, activation of the transmitting module 14, sends a radio frequency signal as shown in FIG. 1 to the receiver. Upon activation by the transmitter 14, a loud beep or horn element is activated via an audio generator 49 and speaker 50.

Figure 4:
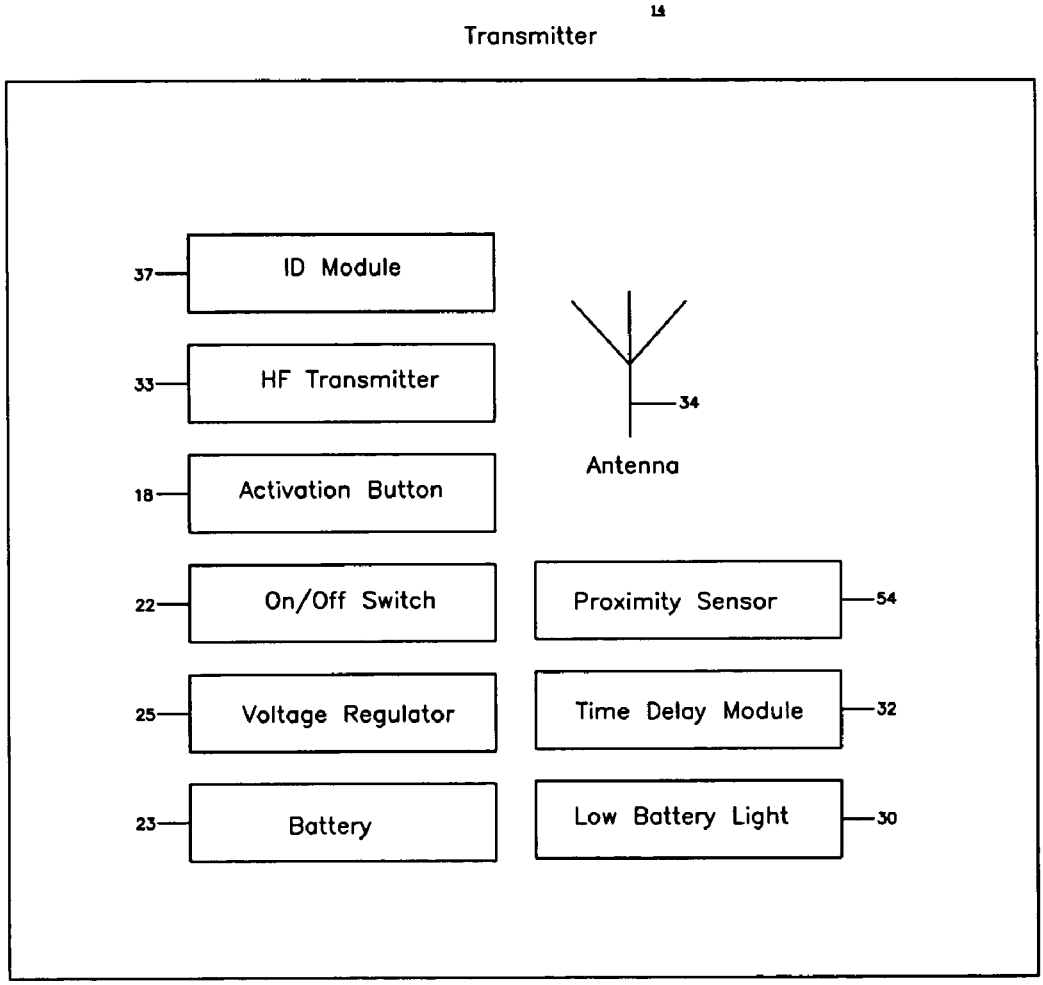
FIGS. 4 and 5 are block diagrams of a further embodiment which includes a proximity sensor.
Figure 5:
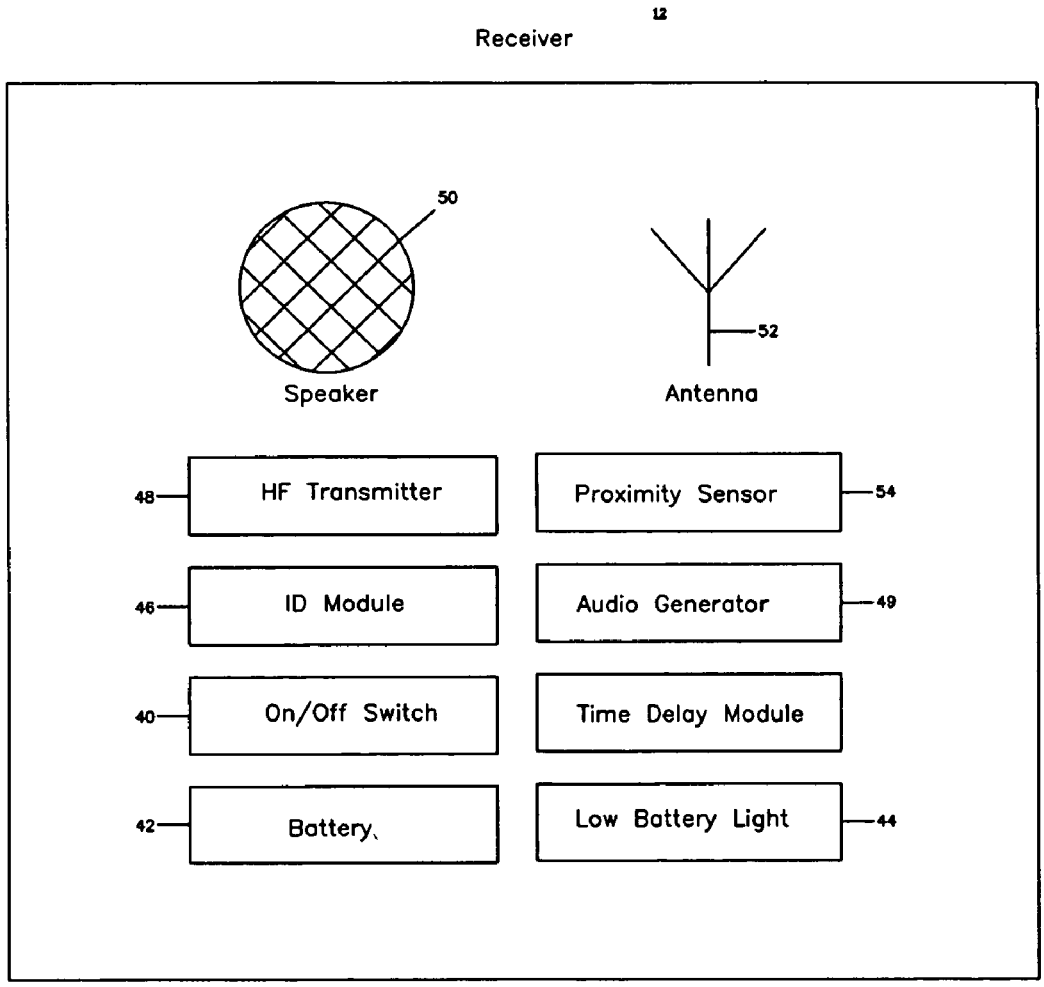

A further embodiment of the invention is now shown in FIGS. 4 and 5. In this embodiment the invention includes a proximity sensor 54. The proximity sensor 54 is designed to send an electronic signal when a child is beyond a certain distance from the transmitter. The sensor can be set so as to trigger the signal at varying distances e.g., 25, 50, 100 feet.

The present invention has been described with reference to the enclosed preferred emboidment. It is to be appreciated that the other emboidments fulfill the spirit and scope of the present invention and that the true nature and scope of the invention's do be determined with response to the claims appended hereto.

The invention claimed is:

1. A child locator system comprising:

a first unit consisting essentially of:

a retaining means;

a receiver for receiving a signal from a transmitter;

an alert means for producing an alarm;

a first identification module for enabling communication using a unique digital binary signature;

a first proximity device that communicates with a second proximity device to indicate when the first unit has exceeded a predetermined distance from a second unit;

a first power supply; and an on/off switch, wherein said receiver, said first identification module and said first proximity sensor are operatively associated with one another to produce or receive a signal, wherein said first unit is an article worn by children or a child's adornment having a shape and wherein said shape is selected from the group consisting of an animal figure, a toy, a ball, a doll and a car; and said second unit consisting essentially of:

said transmitter for transmitting a signal to said receiver;

an activating button for triggering said alert means;

a second power supply;

said second proximity device that communicates with said first proximity device to indicate when the first unit has exceeded a predetermined distance from the second unit; and a second identification module for enabling communication with the first unit using said unique digital binary signature, wherein said transmitter, said second identification module and said second proximity sensor are operatively associated with one another to produce or receive a signal.

2. The child locator system of claim 1, wherein said retaining means is selected from the group consisting of: a chain, a zipper, fabric, buttons, snaps, clasps and lace.

3. The child locator system of claim 1, wherein said second unit is a portable, hand held, water resistant device capable of being attached to a key chain.

4. The child locator system of claim 1, further comprising a time delay module adapted to be used with either said first unit or said second unit.

5. The child locator system of claim 1, further comprising a battery level indicator adapted to be used with either said first unit or said second unit.

6. The child locator system of claim 5, further comprising a voltage regulator adapted to be used with said second unit.

7. The child locator system of claim 1, wherein said first unit is a child's adornment having a shape and wherein said shape is an animal figure.

8. The child locator system of claim 1, further comprising a second on/off switch adapted to be used with the second unit.

9. A child locator system comprising:

a first unit, first unit consists essentially of:

a receiver for receiving a signal from a transmitter;

an alert means for producing an alarm;

a first antenna;

a first power supply;

a retaining means for retaining said first unit proximate to a child;

a first identification module for enabling communication using a unique digital binary signature, wherein said first identification module is operatively associated with said receiver; and an on/off switch, wherein said first unit is an article worn by children or a child's adornment having a shape, and wherein said shape is selected from the group consisting of an animal figure, a toy, a ball, a doll and a car; and a second unit consisting essentially of:

said transmitter for transmitting to said receiver;

an activating button for triggering said alert means;

a second antenna;

a second power supply; and a second identification module for enabling communication with first unit using said unique digital binary signature, wherein said second identification module is operatively associated with said transmitter.

10. The child locator system of claim 9, further comprising a time de1ay module adapted to be used with either said first unit or said second unit.

11. The child locator system of claim 9, further comprising a battery level indicator adapted to be used with either said first unit or said second unit.

12. The child locator system of claim 11, further comprising a voltage regulator adapted to be used with said second unit.

13. The child locator system of claim 9, wherein said first unit is a child's adornment having a shape and wherein said shape is an animal figure.

14. The child locator system of claim 9, wherein said second unit is a portable, hand held and water resistant device capable of being attached to a key chain.

15. The child locator system of claim 9, further comprising:

a first proximity device adapted to be used with the first unit and a second proximity device adapted to be used with the second unit, wherein said first proximity device communicates with said second proximity device to indicate when said first unit has exceeded a predetermined distance from said second unit.

16. The child locator system of claim 9, further comprising a second on/off switch adapted to be used with the second unit.

* * * * *